United States Patent [19]

Campbell

[11] Patent Number: 4,833,791

[45] Date of Patent: May 30, 1989

[54] STEP LAYOUT DEVICE

[76] Inventor: Stanley D. Campbell, Rt. 2, Box 103, Lebanon, Va. 24266

[21] Appl. No.: 149,380

[22] Filed: Jan. 28, 1988

[51] Int. Cl.[4] ..... B43L 13/20

[52] U.S. Cl. ..... 33/562; 33/464

[58] Field of Search ..... 33/562, 563, 565, 566, 33/427, 478, 456, 458, 1 G, 29

[56] References Cited

U.S. PATENT DOCUMENTS 164,008 6/1975 Kirkpatrick ..... 33/427

FOREIGN PATENT DOCUMENTS 15619 9/1956 Fed. Rep. of Germany ..... 33/464

*Primary Examiner*—Harry N. Haroian

[57] ABSTRACT

A step layout device for giving a visual and physical representation of riser and tread dimensions which have been or are being selected for a stairway, wherein the device has at least one lower and one upper pair of planar members, the members of each pair having cooperating vertical ruled portions and cooperating adjustable connector mechanisms adapted to planarly connect the members of each pair in selected vertically dimensioned riser postures, the pairs having adjacent horizontal edge portions provided with cooperating horizontal ruled portions, and cooperating adjustable connector mechanisms on the pairs adapted to planarly connect the pairs in selected horizontally dimensioned tread postures.

4 Claims, 2 Drawing Sheets

STEP LAYOUT DEVICE

This invention concerns devices of the type designed to assist in the dimensioning and layout of complicated patterns, particularly stairways, wherein if an error, even minor, in measurement is once made, the end result can be calamitous, such as, e.g., the well known deep first step at the top of the stairs.

The present invention has as its principal object therefore, to provide a layout device, especially one having the angular feature of a square, which can be used to give both a visual and physical representation of the relative dimensions and physical relationship of riser and tread, such that the builder can use the physical representation as a template or square to actually mark the stair carriage or casing sides for proper positioning of the risers and treads, and/or to visually check the installation of risers and treads as construction of the stairway proceeds.

This and other objects hereinafter appearing have been attained in accordance with the present invention through the discovery of the construction for a step layout device for giving a visual and physical representation of riser and tread dimensions which have been or are being selected for a stairway, said device comprising at least one lower and one upper pair of planar members, the members of each pair having cooperating vertical ruler means and cooperating adjustable connector means adapted to planarly connect the members of each pair in selected vertically dimensioned riser postures, said pairs having adjacent horizontal edge portions provided with cooperating horizontal ruler means, and cooperating adjustable connector means on said pairs adapted to planarly connect said pairs in selected horizontally dimensioned tread postures.

In preferred embodiments of the present invention:

each said vertical ruler means comprises integer and fractional markings on at least one of the coincident edge portions of the pair members;

the said horizontal ruler means comprises integer and fractional markings on the horizontal edge portion of an adjacent member of the pairs; and each of the members has a substantially rectangular configuration.

The invention will be further understood from the following description and drawings wherein.

Figure 1:
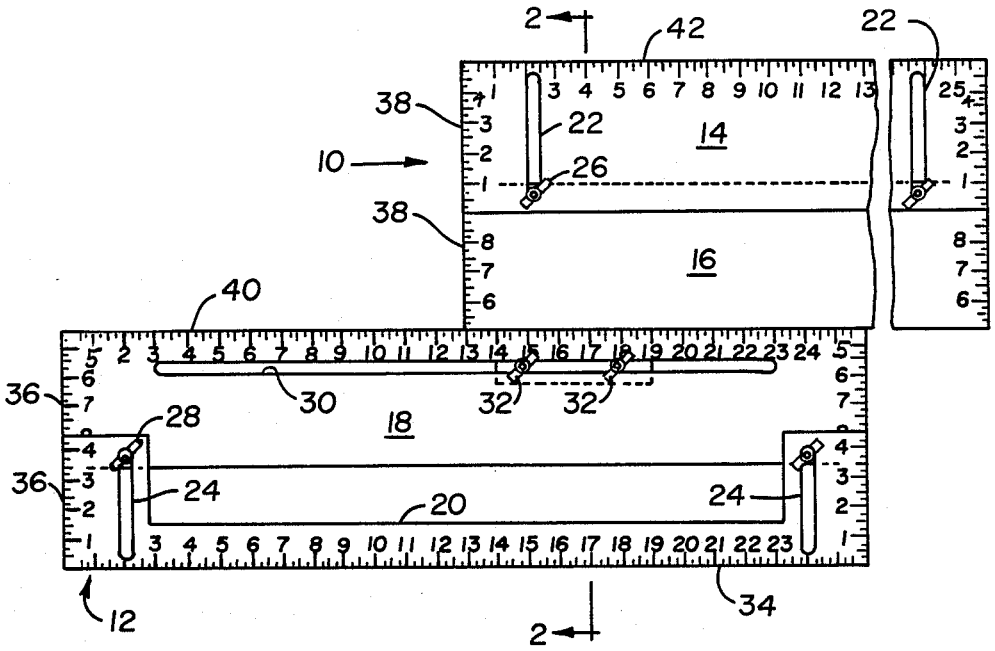
FIG. 1 is a front view of the present device.
Figure 2:
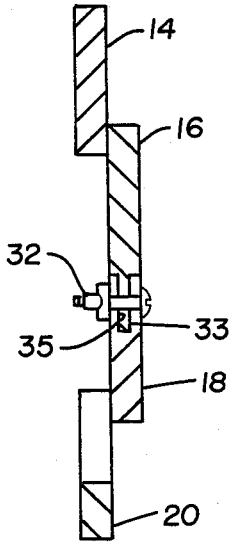
FIG. 2 is a cross-sectional view taken along line 2—2 of FIG. 1 in the direction of the arrows.
Figure 3:
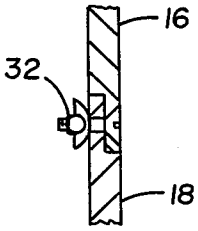
FIG. 3 is a view as in FIG. 2 showing a variation in construction of the horizontal sliding joint.
Figure 4:
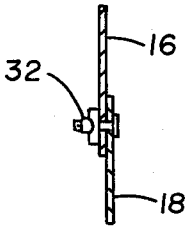
FIG. 4 is a view as in FIG. 3 showing planar effect obtained by the use of thin sheet metal.

Referring to the drawing, the present layout device or square comprises at least two pairs exemplified by 10 and 12 of vertically adjustable members 14 and 16, and 18 and 20 respectively. These members preferably have a rectangular configuration such that their edges may be conveniently used for scribing or marking purposes as in pencilling the actual stair riser and tread outline on the stair carriage side supports. As aforesaid, each pair is provided with a vertical adjustment means which, in the exemplary embodiment shown, comprises slots 22 and 24 in members 14 and 20 respectively which slidably receive wing nut type assemblies 26 and 28 respectively. The length of the slots dictate the extent of the vertical adjustment between the member of each pair, however, the slots may be placed in both members of each pair in order to maximize the adjustment and minimize the slot lengths which would afford greater structural integrity of the members.

In the embodiment shown, pair 12 has a minimum height in the closed position of four and one half inches, which with the addition of a one and one half inch tread would be satisfactory as a minimum riser height for the vast majority of situations. The minimum height in the closed position of pair 10 is shown as five inches, however a preferable height would be the treadthickness (e.g. 1.5 inches) more than the 4.5 inches of pair 12, i.e., six inches, such that employing the device with both pairs closed would give a consistent and quick first and second step height template of six inches. It is noted that errors in stair lay-out often occur at the first and second steps since it is easy not to take into account that the floor is in fact, a first thread. The maximum riser height for each pair as shown would be adequate for all conventional stairs. Should a greater range of riser heights be desired for special applications, then the dimensions of the members can be altered, and/or multiple members can be used, e.g., three or four members for each pair provided with suitable slot and fastening, non-interfering mechanisms.

The horizontal or tread width adjustment is provided by means of slot 30 in member 18 and wing nut assemblies 32 mounted in a depending segment 33 of member 16. If desired, segment 33 and the slot 35 in which it slides may be extended, e.g., the full lengths of members 16 and 18 to give increased lateral support to the members and enhance their alignment. The embodiment shown provides for tread width adjustments betwen one and eighteen inches which again, is entirely adequate for any conventional stairway.

The ruler markings along the edges of the members may, of course, be in any convention e.g., inches or metric and in any division thereof, and may comprise tape affixed to the members, or permanent markings thereon formed by printing, etching, embossing or the like. The material of construction is essentially at the option of the manufacturer and can be clear plastic sheeting of a thickness for example, of from about 1/16 to about ⅜ inches, however, metal, wood or any other solid material also may be used. Metal sheet as shown in FIG. 14 has the advantage of providing a more flat planar unit which would be easier to use as a template.

The manner in which the present device is used depends upon the particular construction technique used by the builder. For example, where a typical sheet rock wall defines one or both sides of the stairway, the device is simply placed with its bottom edge 34 resting on the floor and the members 14, 16, 18 and 20 as flat as possible against the wall. The outlines of the riser and treads represented by edges 36 and 38, and 40 and 42 respectively, are then readily marked on the wall. The exact initial positioning of the device on the floor, and dimensions of the risers and treads, of course, would have been previously determined by calculation techniques known in the art. Similarly, the outline can be traced progressively upwardly for positioning all of the stair risers. The present device can also be used to lay out the stairway outline on the stairway carriage or sideboards prior to the carriage being placed in position. The calculation techniques for such an operation again are well known in the art.

Figure 5:
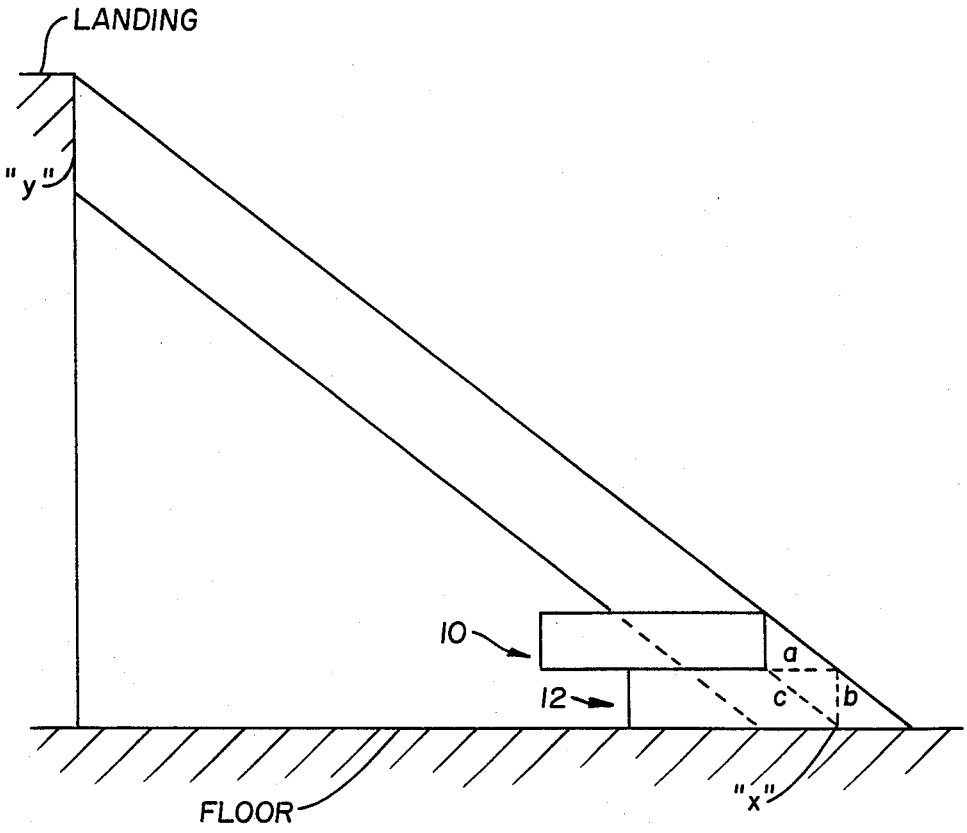
FIG. 5 is a side view of a stair carriage as employed for layout calculations.

With reference to FIG. 5, an examplary determination of the settings for the present device for building a stairway between two floors of a house is given below in steps 1–5 wherein the numerical values have been taken from precalculated tables I and II wherein dimensions are in inches:

1. determine floor to floor height of, e.g., 120";
2. select desired riser height from table I, e.g., 6-21/32" from column D;
3. determine number of risers needed, e.g., 18 from column D' of Table I;

4. select tread width, e.g., 11¼" from Table II, columns F and I;
5. determine carriage length (x−y) by multiplying the number of risers (18) by the carriage factor 13.0716 from Table II, column J, the result of which is 235.29".

With reference to FIG. 5, the carriage factor (CF) is precalculated from riser heights "b" and tread widths "a" according to the equation $CF=\sqrt{a^2+b^2}$.

It is noted that Tables I and II are exemplary in nature, illustrating a convenient reference for quickly determining possible stair dimensions, and are not intended to limit the utility of the present device.

TABLE I

| FLOOR TO FLOOR HEIGHT | RISER HEIGHT SETTING | | | | | NUMBER OF RISERS | | | | |
|---|---|---|---|---|---|---|---|---|---|---|
| | A | B | C | D | E | A' | B' | C' | D' | E' |
| 94 | 7 27/32 | 7 7/32 | 6 23/32 | 6 9/32 | | 12 | 13 | 14 | 15 | |
| 95 | 7 29/32 | 7 5/16 | 6 25/32 | 6 11/32 | | 12 | 13 | 14 | 15 | |
| 96 | 8 | 7⅜ | 6 27/32 | 6 13/32 | 6 | 12 | 13 | 14 | 15 | 16 |
| 97 | 8 3/32 | 7 15/32 | 6 15/16 | 6 15/32 | 6 1/16 | 12 | 13 | 14 | 15 | 16 |
| 98 | 8 5/32 | 7 17/32 | 7 | 6 17/32 | 6⅛ | 12 | 13 | 14 | 15 | 16 |
| 99 | 8¼ | 7⅝ | 7 1/16 | 6 19/32 | 6 3/16 | 12 | 13 | 14 | 15 | 16 |
| 100 | 7 11/16 | 7 5/32 | 6 21/32 | 6¼ | | 13 | 14 | 15 | 16 | |
| 101 | 7 25/32 | 7 7/32 | 6 23/32 | 6 5/16 | | 13 | 14 | 15 | 16 | |
| 102 | 7 27/32 | 7 9/32 | 6 13/16 | 6⅜ | | 13 | 14 | 15 | 16 | |
| 103 | 7 15/16 | 7 11/32 | 6⅞ | 6 7/16 | | 13 | 14 | 15 | 16 | |
| 104 | 8 | 7 7/16 | 6 15/16 | 6½ | | 13 | 14 | 15 | 16 | |
| 105 | 8 1/16 | 7½ | 7 | 6 9/16 | 6 3/16 | 13 | 14 | 15 | 16 | 17 |
| 106 | 8 5/32 | 7 9/16 | 7 1/16 | 6⅝ | 6¼ | 13 | 14 | 15 | 16 | 17 |
| 107 | 8 7/32 | 7 21/32 | 7⅛ | 6 11/16 | 6 9/32 | 13 | 14 | 16 | 16 | 17 |
| 108 | 7 23/32 | 7 3/16 | 6¾ | 6 11/32 | | 14 | 15 | 16 | 17 | |
| 109 | 7 25/32 | 7 9/32 | 6 13/16 | 6 13/32 | | 14 | 15 | 16 | 17 | |
| 110 | 7 27/32 | 7 11/32 | 6⅞ | 6 15/32 | | 14 | 15 | 16 | 17 | |
| 111 | 7 15/16 | 7 13/32 | 6 15/16 | 6 17/32 | | 14 | 15 | 16 | 17 | |
| 112 | 8 | 7 15/32 | 7 | 6 19/32 | | 14 | 15 | 16 | 17 | |
| 113 | 8 1/16 | 7 17/32 | 7 1/16 | 6 21/32 | | 14 | 15 | 16 | 17 | |
| 114 | 8 5/32 | 7 19/32 | 7⅛ | 6 23/32 | | 14 | 15 | 16 | 17 | |
| 115 | 8 7/32 | 7 21/32 | 7 3/16 | 6¾ | | 14 | 15 | 16 | 17 | |
| 116 | 7 23/32 | 7¼ | 6 13/16 | 6 7/16 | | 15 | 16 | 17 | 18 | |
| 117 | 7 3/16 | 7 5/16 | 6⅞ | 6½ | | 15 | 16 | 17 | 18 | |
| 118 | 7 7/8 | 7⅜ | 6 15/16 | 6 9/16 | | 15 | 16 | 17 | 18 | |
| 119 | 7 15/16 | 7 7/16 | 7 | 6⅝ | | 15 | 16 | 17 | 18 | |
| 120 | 8 | 7½ | 7 1/16 | 6 21/32 | | 15 | 16 | 17 | 18 | |
| 121 | 8 1/16 | 7 9/16 | 7⅛ | 6 23/32 | | 15 | 16 | 17 | 18 | |
| 122 | 8⅛ | 7⅝ | 7 3/16 | 6 25/32 | | 15 | 16 | 17 | 18 | |
| 123 | 7 11/16 | 7¼ | 6 27/32 | | | 16 | 17 | 18 | | |
| 124 | 7¾ | 7 9/32 | 6⅞ | | | 16 | 17 | 18 | | |
| 125 | 7 13/16 | 7 11/32 | 6 15/16 | | | 16 | 17 | 18 | | |

TABLE II

| F RISER HEIGHT | G MINIMUM TREAD WIDTH | H CARRIAGE FACTOR (CF) | I MAXIMUM TREAD WIDTH | J CARRIAGE FACTOR (CF) |
|---|---|---|---|---|
| 6 | 12 | 13.4164 | 12½ | 13.8654 |
| 6 1/32 | 11 31/32 | 13.4024 | 12 13/32 | 13.7942 |
| 6 1/16 | 11 29/32 | 13.3608 | 12 11/32 | 13.7521 |
| 6 3/32 | 11 27/32 | 13.3194 | 12 9/32 | 13.7099 |
| 6⅛ | 11 25/32 | 13.2783 | 12 7/32 | 13.6679 |
| 6 5/32 | 11 23/32 | 13.2373 | 12 5/32 | 13.6262 |
| 6 3/16 | 11 21/32 | 13.1967 | 12 3/32 | 13.5846 |
| 6 7/32 | 11 19/32 | 13.1562 | 12 1/32 | 13.5450 |
| 6¼ | 11 9/16 | 13.1435 | 12 | 13.5300 |
| 6 9/32 | 11 15/32 | 13.0761 | 11 15/16 | 13.4891 |
| 6 5/16 | 11 7/16 | 13.0638 | 11⅞ | 13.4485 |
| 6 11/32 | 11⅜ | 13.0243 | 11 13/16 | 13.4081 |
| 6⅜ | 11 5/16 | 12.9851 | 11¾ | 13.3679 |
| 6 13/32 | 11¼ | 12.9461 | 11 11/16 | 13.3280 |
| 6 7/16 | 11 3/16 | 12.9074 | 11⅝ | 13.2884 |
| 6 15/32 | 11 5/32 | 12.8959 | 11 19/32 | 13.2762 |
| 6½ | 11 3/32 | 12.8577 | 11 17/32 | 13.2370 |
| 6 17/32 | 11 1/32 | 12.8197 | 11 15/32 | 13.1980 |
| 6 9/16 | 11 | 12.8088 | 11 13/32 | 13.1593 |
| 6 19/32 | 10 15/16 | 12.7713 | 11⅜ | 13.1479 |
| 6⅝ | 10⅞ | 12.7340 | 11 5/16 | 13.1096 |
| 6 21/32 | 10 27/32 | 12.7236 | 11¼ | 13.0716 |
| 6 11/16 | 10 25/32 | 12.6868 | 11 3/16 | 13.0339 |
| 6 23/32 | 10 23/32 | 12.6503 | 11 5/32 | 13.0231 |
| 6¾ | 10 11/16 | 12.6406 | 11 3/32 | 12.9896 |

TABLE II-continued

| F RISER HEIGHT | G MINIMUM TREAD WIDTH | H CARRIAGE FACTOR (CF) | I MAXIMUM TREAD WIDTH | J CARRIAGE FACTOR (CF) |
|---|---|---|---|---|
| 6 25/32 | 10⅝ | 12.6046 | 11 1/32 | 12.9488 |
| 6 13/16 | 10 19/32 | 12.5951 | 11 | 12.9387 |
| 6 27/32 | 10 17/32 | 12.5595 | 10 15/16 | 12.9021 |
| 6⅞ | 10½ | 12.5505 | 10 29/32 | 12.8923 |
| 6 29/32 | 10 7/16 | 12.5154 | 10 27/32 | 12.8561 |
| 6 15/16 | 10 13/32 | 12.5067 | 10 25/32 | 12.8204 |
| 6 31/32 | 10 11/32 | 12.4722 | 10¾ | 12.8111 |
| 7 | 10 5/16 | 12.4638 | 10 11/16 | 12.7758 |
| 7 1/32 | 10¼ | 12.4298 | 10 21/32 | 12.7668 |
| 7 1/16 | 10 7/32 | 12.4218 | 10 19/32 | 12.7321 |
| 7 3/32 | 10 5/32 | 12.3883 | 10 9/16 | 12.7235 |

As aforesaid, more than two pairs such as 10 and 12 may be employed, and theoretically, twenty or thirty or so pairs may be provided to afford a complete template for any size stairway, still utilizing the basic concepts of the present invention as embodied in the two pairs shown.

The invention has been described in detail with particular reference to preferred embodiments thereof, but it will be understood that variations and modifications will be effected within the spirit and scope of the invention.

I claim:

1. A step layout device for giving a visual and physical representation of riser and tread dimensions which have been or are being selected for a stairway, said device comprising at least one lower and one upper pair of planar rectangular members, the members of each pair having the same lengths and forming a rectangle, cooperating vertical ruler means on each of the members of each pair, and cooperating, vertically adjustable connector means on the members of each pair adapted to planarly connect the members of each pair in selected vertically dimensioned riser postures wherein the members of each pair form an adjusted rectangle, said pairs having adjacent horizontal edge portions provided with cooperating horizontal ruler means, and cooperating adjustable connector means on said pairs adapted to planarly connect said pairs in selected horizontally dimensioned tread postures.

2. The device of claim 1 wherein each said vertical ruler means comprises integar and fractional markings on at least one of the coincident edge portions of the pair members.

3. The device of claim 2 wherein the said horizontal ruler means comprises integer and fractional markings on the horizontal edge portion of an adjacent member of the pairs.

4. The device of claim 3 wherein each of the members has a substantially rectangular configuration.

* * * * *